US007261483B2

(12) United States Patent
Gueret

(10) Patent No.: US 7,261,483 B2
(45) Date of Patent: Aug. 28, 2007

(54) DEVICE, SYSTEM, AND METHOD FOR APPLYING A PRODUCT

(75) Inventor: Jean-Louis H. Gueret, Paris (FR)

(73) Assignee: L'Oréal S.A., Paris (FR)

( * ) Notice: Subject to any disclaimer, the term of this patent is extended or adjusted under 35 U.S.C. 154(b) by 536 days.

(21) Appl. No.: 10/424,715

(22) Filed: Apr. 29, 2003

(65) Prior Publication Data

US 2004/0018037 A1 Jan. 29, 2004

Related U.S. Application Data

(60) Provisional application No. 60/381,798, filed on May 21, 2002.

(30) Foreign Application Priority Data

Apr. 30, 2002 (FR) ..... 02 05434

(51) Int. Cl.
*A46B 11/00* (2006.01)

(52) U.S. Cl. ..... 401/126; 401/119; 401/122; 401/129

(58) Field of Classification Search ..... 401/119, 401/122–124, 127, 129, 130
See application file for complete search history.

(56) References Cited

U.S. PATENT DOCUMENTS

| | | | | |
|---|---|---|---|---|
| 5,490,737 | A * | 2/1996 | Gueret | 401/122 |
| 5,491,865 | A | 2/1996 | Gueret | |
| 5,899,622 | A * | 5/1999 | Gueret | 401/122 |
| 6,026,824 | A | 2/2000 | Gueret | |
| 6,067,997 | A | 5/2000 | Gueret | |
| 6,073,634 | A | 6/2000 | Gueret | |
| 6,096,382 | A | 8/2000 | Gueret | |
| 6,386,781 | B1 | 5/2002 | Gueret | |
| 6,390,708 | B1 | 5/2002 | Gueret | |
| 6,591,842 | B2 | 7/2003 | Gueret | |
| 6,634,821 | B2 | 10/2003 | Gueret | |
| 6,682,244 | B2 | 1/2004 | Gueret | |
| 2001/0031168 | A1 * | 10/2001 | Gueret | 401/123 X |
| 2002/0019645 | A1 * | 2/2002 | Fischer et al. | 606/161 |
| 2002/0023658 | A1 | 2/2002 | Gueret | |

FOREIGN PATENT DOCUMENTS

| | | |
|---|---|---|
| FR | 2 759 872 | 8/1998 |
| FR | 2 796 532 | 1/2001 |
| FR | 2 812 176 | 2/2002 |
| JP | A H8-33518 | 2/1996 |
| JP | A H10-94424 | 4/1998 |
| JP | A 2000-50946 | 2/2000 |
| JP | A 2001-61546 | 3/2001 |
| JP | A 2001-97434 | 4/2001 |
| JP | A 2002-67201 | 3/2002 |

* cited by examiner

*Primary Examiner*—Khoa D. Huynh
(74) *Attorney, Agent, or Firm*—Finnegan, Henderson, Farabow, Garrett & Dunner, LLP

(57) ABSTRACT

A device for applying a product may include a support defining at least one relief-free surface extending continuously over substantially the entire length of the support. The surface may be at least partially covered with a flocking layer including fibers configured to allow the device to be loaded with product. The fibers may include at least two fibers differing from one another, wherein the at least two fibers may be configured to define, at the surface of the flocking layer, irregularities which are at least one of visible to the naked eye and perceptible to the touch.

2 Claims, 6 Drawing Sheets

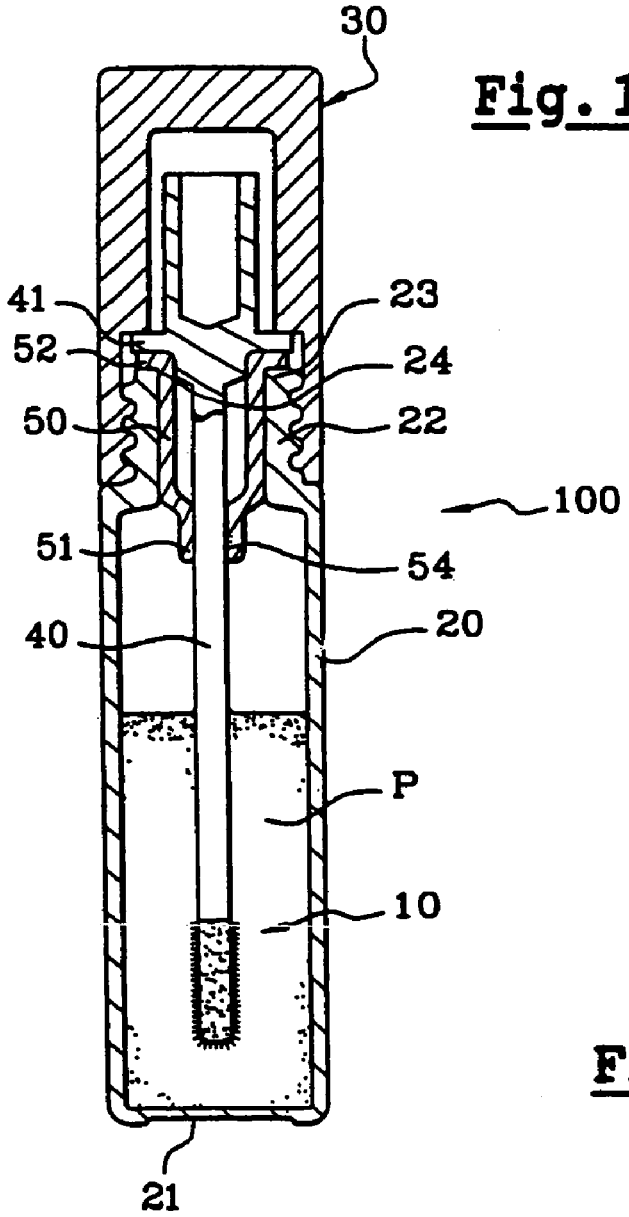
Fig. 1
Fig. 1A
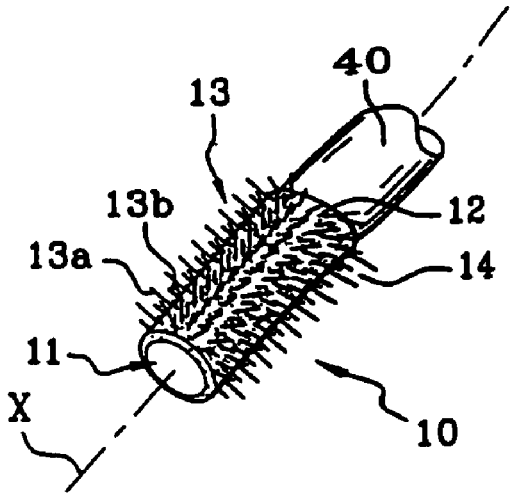

DEVICE, SYSTEM, AND METHOD FOR APPLYING A PRODUCT

BACKGROUND OF THE INVENTION

1. Field of the Invention

This application claims the benefit of priority under 35 U.S.C. § 119(e) of U.S. provisional application No. 60/381,798, filed May 21, 2002.

The present invention relates to a device and method for applying a product, for example, a cosmetic product, wherein the device may include a flocked application surface.

2. Description of Related Art

In the field of devices and methods for applying a product, for example, a make-up product, applicators may include a flocked application surface, for example, for applying mascara, eyeliner, lip gloss, etc. Some of those applicators may be generally covered with one type of fiber, the characteristics of which may be selected as a function of, for example, the product to be applied.

Applicators covered with flocking having a single type of fiber, however, have a number of drawbacks. On the one hand, since the fibers of the flocking are identical, they may form a relatively uniform application surface. On the other hand, since the fibers may be implanted very close together, they may not form spaces between the fibers, which may substantially prevent a large amount of product from being held at the application surface. The resulting applicator may therefore have a very dense application surface, which may prevent it from retaining a sufficient amount of product at the application surface and which may prevent it from delivering a large amount of product on the surface to be made up. Furthermore, because the application surface may be very thickly flocked, the relatively small amount of product applied on the surface to be made up may often be removed by the fibers as the applicator passes over it. This may render it very difficult to obtain a strong make-up effect with this type of applicator. Moreover, when fibers with a relatively large diameter are used, the resulting application surface may be relatively hard and may tend to irritate the surface to be made up. On the other hand, when using fibers with a relatively small diameter, which may allow for a gentler application, the applicator may not be able to retain a sufficient amount of product and may not therefore deposit enough of the product on the surface to be made up.

One subject of the invention relates to providing an application device that may not have one or more of the aforementioned problems of the prior art. For example, one subject of the invention relates to providing an application device that may render it possible to obtain a relatively strong make-up effect while having a relatively soft application surface. Another subject of the invention relates to producing an application device that may be used for applying various types of products simply by modifying the types of fibers of the flocking that may substantially cover the application surface.

Although the present invention may obviate one or more of the above-mentioned needs, it should be understood that some aspects of the invention might not necessarily obviate one or more of those needs.

SUMMARY OF THE INVENTION

In the following description, certain aspects and embodiments will become evident. It should be understood that the invention, in its broadest sense, could be practiced without having one or more features of these aspects and embodiments. It also should be understood that these aspects and embodiments are merely exemplary.

In one aspect, as embodied and broadly described herein, the invention includes a device for applying a product. The device may include a support defining at least one relief-free surface extending continuously over substantially the entire length of the support. The surface may be at least partially covered with a flocking layer including fibers configured to allow the device to be loaded with product. The fibers may include at least two fibers differing from one another, and the at least two fibers may be configured to define, at the surface of the flocking layer, irregularities which are at least one of visible to the naked eye and perceptible to the touch.

As used herein, "fibers" of a flocking layer are not conventional bristles (i.e., fibers of a flocking layer are not bristles of a conventional brush for applying mascara and/or nail varnish).

The flocking layer may be obtained in an exemplary manufacturing process including the steps of coating the surface to be flocked with an adhesive (e.g., by immersion and/or spraying), and depositing the fibers of the flocking material thereon by, for example, an electrostatic method. Such a method may cause the fibers being oriented substantially perpendicular to a plane of the surface to be flocked. The fibers may hence be distributed relatively uniformly over the adhesive-coated surface of the support. The application device surface substantially covered with the flocking layer may therefore have substantially the same overall shape as that of the support before it is covered with the flocking layer, except, for example, for the added thickness of the flocked layer.

The term "relief-free surface" is intended to mean a surface which does not have any substantial variations that may generate irregularities at the surface of the flocking layer. The irregularities at the surface of the flocking layer result substantially only from differences between the fibers forming the flocking layer. When the relief-free surface of the support is covered with flocking including solely substantially identical fibers, the surface of the flocking layer may have substantially no surface irregularity visible to the naked eye. The relief-free surface does not, for example, have lines, slits, and/or teeth, which may be visible to the naked eye and/or perceptible to the touch.

The term "substantially the entire length" is intended to mean at least half of the length, for example, at least about 75% of the length.

The irregularities that may be visible to the naked eye and/or perceptible to the touch may be due, for example, to the presence of reliefs at the surface of the flocking layer, that may result, for example, from using fibers having different lengths. They may also be due to variations in the density of fibers per unit area, resulting, for example, from using fibers having different diameters and/or different cross-sections. The irregularities which may be perceptible to the touch may, for example, be due to variations in hardness which can be felt at the surface and result, for example, from using fibers having different natures (e.g., fibers including materials having different hardnesses). Fibers having different lengths may also generate variations which may be sensitive to the touch.

According to another aspect, the fibers may include at least a first type of fibers and a second type of fibers, and the flocking layer may include from about 2% to about 98% of the first type of fibers. For example, the flocking layer may include from about 5% to about 95% of the first type of fibers, or from about 10% to about 90% of the first type of fibers.

The flocking layer may include different fibers, for example, fibers having different natures and/or dimensions. The flocking layer may include fibers having at least one of different lengths, different diameters, different cross-sections, different natures, and different colors. For example, the fibers may be selected from fibers having a length ranging from about 0.01 millimeter to about 3 millimeters. For example, the fibers may be selected from fibers having a length ranging from about 0.01 millimeter to about 2 millimeters. For example, the fibers may be selected from fibers having a length ranging from about 0.01 millimeter to about 1 millimeter. For example, the fibers may be selected from fibers having a length ranging from about 0.01 millimeter to about 3 millimeters and a diameter ranging from about 0.01 millimeter to about 0.6 millimeter. When the fibers have a substantially circular cross-section, the term "diameter" is intended to mean the diameter of the substantially circular shape defined by the fiber cross-section. Alternatively, when the fibers have a cross-section that is not substantially circular, the term "diameter" is intended to mean the diameter of a circle which substantially circumscribes the fiber cross-section.

In still another aspect, the fibers may have a cross-section selected from at least one of circular, oval, polygonal, cross-shaped, trilobed, tetralobed, C-shaped, E-shaped, F-shaped, H-shaped, I-shaped, L-shaped, N-shaped, S-shaped, T-shaped, V-shaped, W-shaped, X-shaped, Y-shaped, Z-shaped, star-shaped, and crescent-shaped.

In yet another aspect, the fibers may include at least one material selected from polyamides, polyacrylics, polyesters, cottons, and cellulose. For example, the fibers may include at least one material selected from Nylon®, viscose, and rayon. The fibers may be selected from fibers having any colors.

According to another aspect, the fibers may include straight fibers and curved fibers.

In still another aspect, the fibers may be treated and/or include additives such as, for example, lubricating agents, absorbent agents, anti-UV agents, magnetic and/or magnetizable particles, and bactericidal agents, although the invention is not limited to these aforementioned additives.

In another aspect, substantially the entire surface of the support may be covered with the flocking layer. In some examples, depending on the shape of the applicator and/or the surface to be made up, for example, only part of the support may be covered with the flocking layer.

In yet another aspect, the support may have an elongate shape defining an axis. The elongate shape may include, for example, one of a straight cylindrical shape, a curved cylindrical shape, a straight conical shape, a curved conical shape, a straight frustoconical shape, a curved frustoconical shape, a straight prismatic shape, a curved prismatic shape, feather-shape, rugby ball-shape, bean-shape, and spatula-shape.

In still a further aspect, the support may define a cross-section, wherein the cross-section defines one of a circular shape, an oval shape, a triangular shape, a rectangular shape, and a square shape.

According to another aspect, at least two adjacent fibers may be located along an axis of an elongate shape of the support and may be substantially parallel to one another. For example, the at least two adjacent fibers may extend substantially perpendicular to the axis. According to still another aspect, at least some of the fibers may extend in a different direction than at least some other fibers.

In another aspect, the support and the flocking layer may not be formed in a single-piece molded construction.

In still another aspect, the support may include at least one material selected from rigid materials, semi-rigid materials, thermoplastic materials, glass materials, metals, woods, flexible materials, and elastomers. The support may be porous, for example, so that it may be able to absorb at least some of the product, which may provide a supply of the product. The support may include magnetic and/or magnetizable materials, which may be coated, for example, with a silver resin. The fibers of the flocking layer may include magnetic and/or magnetizable particles (e.g., a silver powder). The support may include a material which has a sufficiently high thermal inertia so that the product which is taken up by the device may be substantially prevented from cooling too quickly, for example, in the event that it is being applied after its temperature has been raised. The support may, for example, include a plastic material including a relatively high proportion of an inorganic and/or other filler, for example, providing it with a relatively high heat capacity.

According to yet another aspect, the device for applying a product may include a gripping component. For example, the gripping component may include a shaft. The support may define an axis and the gripping component may be positioned along the axis. For example, the gripping component may form a substantially non-zero angle with the axis of the support, for example, in order to facilitate application.

In still another aspect, the support and the gripping component may include a single-piece molded construction. In yet another aspect, the gripping component may be fixed to the support by at least one of adhesive bonding, clamping, snap-fastening, and press-fitting.

According to another aspect, at least some of the fibers may be adhesively secured to the support. For example, at least some of the fibers may be adhesively secured to the at least one relief-free surface.

According to yet another aspect, a system for applying a product may include a device for applying a product, a reservoir, and a product to be applied by the device. The product may be contained in the reservoir.

In another aspect, the product may include a cosmetic product other than toothpaste. For example, the cosmetic product may include one of mascara, eyeliner, and lip gloss.

In still another aspect, the reservoir may include a free edge delimiting an opening. For example, the system may include a closure component configured to close the opening of the reservoir in a substantially leak-tight fashion. For example, the device may extend from the closure component and may be configured to be housed inside the reservoir when the closure component closes the opening of the reservoir.

According to a further aspect, the reservoir may include a wiping component arranged proximate the opening. For example, the wiping component may be configured to wipe at least one of the flocking layer and the support (e.g., optionally a shaft), for example, when the device is withdrawn from the reservoir. In another aspect, the wiping component may include at least one material selected from foams, elastomers, and thermoplastic materials and may be optionally covered with flocking.

According to another embodiment, the device may define a substantially spherical shape and may fit in the opening of the reservoir so as to be able to rotate at least partially in the reservoir, for example, so that it can turn like a "roll-on" in the reservoir.

According to yet another aspect, the device may be used for applying a make-up product such as, for example, mascara, eyeliner, nail varnish, eye shadow, and/or lip gloss, and/or for applying a care product such as, for example, a lotion and/or a product for treating hair roots.

In yet another aspect, a method of applying a product to a surface may include providing a system for applying a product, and placing a device in contact with a surface (e.g., skin, nail(s), and/or hair) so as to apply the product to the surface.

The term "providing" is used in a broad sense, and refers to, but is not limited to, making available for use, enabling usage, giving, supplying, obtaining, getting a hold of, acquiring, purchasing, manufacturing, selling, distributing, possessing, making ready for use, and/or placing in a position ready for use.

According to a further aspect, a method of applying a product may include removing at least a portion of the device from the reservoir. In still a further aspect, the device may be placed in contact with the surface without removing the device from the reservoir.

According to yet another aspect, a method of making a device for applying a product may include adhesively securing fibers to a support. For example, the fibers may be secured to at least one relief-free surface.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate exemplary embodiments of the invention and, together with the description, serve to explain some principles of the invention. In the drawings, FIG. 1 is a schematic partial section view of an embodiment of a system for applying a product;

FIG. 1A is a partial schematic perspective view of an embodiment of a device for applying a product;

DESCRIPTION OF EMBODIMENTS

Figure 2:
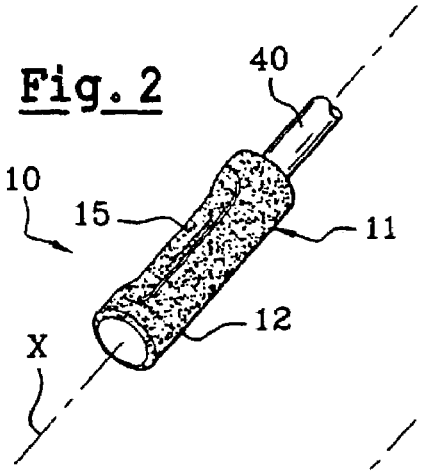
FIG. 2 is a partial schematic perspective view of another embodiment of a device for applying a product.

Reference will now be made in detail to some possible embodiments of the invention, examples of which are illustrated in the accompanying drawings. Wherever possible, the same reference numbers are used in the drawings and the description to refer to the same or like parts.

FIG. 1 depicts an exemplary embodiment of a system for applying a product (e.g., an application assembly 100) on which it may be possible to fit an applicator 10 intended, for example, to apply mascara. The application assembly 100 may include a reservoir 20 (e.g., a cylinder-shaped reservoir) closed by a bottom 21. On the opposite side from the bottom 21, the reservoir 20 may be extended by a neck 22 having a diameter less than that of the reservoir 20. A free edge 23 of the neck 22 defines an opening 24. The neck 22 may include an external screw thread which mates with an internal screw thread of a sleeve 30 (e.g., a cylindrical sleeve) configured to close the reservoir 20 in a substantially leak-tight fashion. A shaft 40 may be fixed in the sleeve 30 and one of its ends may be secured to the applicator 10. The sleeve 30 may be used as an element for gripping the applicator 10. The shaft 40 may include a radial extension 41, which is located inside the sleeve 30 and has a diameter substantially identical to the outer diameter of the neck 22. The extension 41 may be fixed on the sleeve 30. When the sleeve 30 is screwed onto the neck 22 of the reservoir 20, the applicator 10 may be substantially immersed in the product P contained in the reservoir 20.

A wiping component 50, which may be, for example, in the shape of a glove finger and may include a wiping lip 51 (e.g., a circular wiping lip) on the reservoir side, may be inserted into the neck 22. On the opposite side, the wiping component 50 may include a collar 52, which may extend radially outwards and may rest on the neck 22 of the reservoir 20. When the assembly 100 is fitted together, the radial extension 41 of the shaft 40 may bear against the collar 52, and may serve as a seal. The wiping component 50 may include an elastomeric and/or thermoplastic material, which may be selected from, for example, thermoplastic elastomers and/or natural and/or synthetic rubbers. At least part of the wiping lip 51 may be covered by a flocking layer 54. Alternatively, it may be possible to use an optionally flocked foam wiper.

FIG. 1A depicts an exemplary embodiment of an applicator 10 in more detail. The applicator 10 may include a support 11 having an axis X and may be in the shape of, for example, a cylinder of revolution. The support 11 may be formed as an extension of the shaft 40, which may extend along the axis X. According to some embodiments, the support 11 may form a substantially non-zero angle with the axis X of the shaft 40. The support 11 may be obtained, for example, by molding it as a single piece with the shaft 40. Alternatively, the support 11 may be snap-fastened, adhesively bonded, and/or welded to the shaft 40.

The support 11 of the applicator 10 may be, for example, formed of a semi-rigid elastomeric material, whose Shore A hardness ranges from about 25 to about 40 and which may include a material selected from at least one of thermoplastics, thermoplastic elastomers, natural rubbers, and synthetic rubbers. The support 11 may define a substantially smooth surface 12 over substantially its entire length. For example, the support 11 may not have any irregularity visible to the naked eye.

The surface 12 may then be covered with a flocking layer including a mixture of, for example, two different types of fibers 13*a* and 13*b*. The mixture of fibers may include about 75% by weight of a first type of fibers 13*a*, and about 25% by weight of a second type of fibers 13*b*. The two types of fibers 13*a* and 13*b* may, for example, be cotton fibers having a circular cross-section of a substantially identical diameter but a different length. For example, the fibers 13*a* and 13*b* may have a diameter of 0.1 millimeter, while the fibers 13*a* may have a length of about 1 millimeter and the fibers 13*b* may have a length of about 0.5 millimeter. In embodiments in which the surface 12 of the support 11 is substantially smooth and substantially without any irregularity, the fibers 13*a* and 13*b* may be oriented substantially parallel to each other. With such an exemplary arrangement of fibers, the flocking layer may have a surface that includes a relief so that it is not uniform, for example, as shown in FIG. 1A. A space 14 may be formed between two longer fibers 13*a* and may render it possible to retain a relatively large quantity of product P. The fibers 13*a* and 13*b* may be implanted substantially perpendicular to the axis X of the support 11 so that, for example, during application of the product P, the eyelashes to be made up pass through the spaces 14 and receive some of the product P. In such an exemplary configuration, the applicator 10 may render it possible to obtain a relatively strong make-up effect. Furthermore, the longer fibers 13*a* may provide softness during application. The fibers 13*a* and 13*b* may also include additives, such as, for example, lubricating agents for resulting in a relatively more comfortable application of the product P. As a result, if it is desired to obtain an applicator (e.g., a brush) which takes up even more product P, it may be sufficient to increase the percentage of shorter fibers 13*b* in order to obtain more spaces 14 for product retention.

In order to produce such an applicator 10, the support 11 may be formed first, for example, by molding it with the shaft 40. The external surface 12 of the support 11 may then be coated with a liquid adhesive, for example, an acrylic adhesive, a vinyl adhesive, and/or an elastomer epoxy adhesive. The adhesive may be applied by immersion and/or by spraying the adhesive using a gun. For exemplary embodiments in which substantially the entire surface 12 of the support is flocked and in which the support 11 is porous, it may be desired to ensure that the adhesive forms a permeable and/or porous coat so as not to impair the capacity of the support 11 to deeply absorb some of the product, and to release it at the desired locations. When the support 11 is porous, it may be desired for it not to be coated with adhesive over substantially its entire surface.

A support 11 impregnated in this manner may then be passed through a mixture of fibers 13. The mixture of fibers 13 may be electrostatically charged and suspended in air and may be deposited on the impregnated surface of the support 11 by, for example, electrostatic attraction. By virtue of such an exemplary method, the mixture of fibers 13 may become oriented substantially perpendicular to the impregnated surface. Any surplus fibers may thereafter be removed by, for example, suction.

Figure 2A:
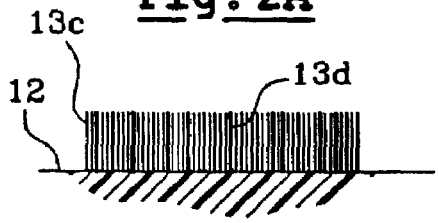
FIG. 2A is a schematic partial section view of the embodiment of FIG. 2.

FIG. 2 depicts another exemplary embodiment of an applicator 10. The applicator 10 shown in FIG. 2 differs from the one depicted in FIG. 1 by virtue of the support 11 including, for example, a polyester elastomer. The support 11 may also be formed separately from the shaft 40, onto which the support 11 may be fixed via, for example, snap-fastening. The support 11, which may be in the shape of a cylinder of revolution, may include a notch 15 extending along the axis X over substantially its entire length. The application component may differ from the one described with respect to FIG. 1 by virtue of its flocking, which is depicted in FIG. 2A.

The flocking layer in the exemplary embodiment depicted in FIG. 2 may include a mixture of two types of, for example, polyamide fibers having a circular cross-section, which may have a substantially identical length, but a different diameter. The two types of fibers 13*c* and 13*d* may have, for example, a length of about 0.5 millimeter. A first fiber type 13*c* may have a diameter of about 0.1 millimeter, and a second fiber type 13*d* may have a diameter of about 0.2 millimeter. The mixture of fibers may include about 80% by weight of fibers of the first type of fibers 13*c* and about 20% by weight of the second type of fibers 13*d*. Such a mixture of fibers may render it possible to obtain a flocking layer that has a variable density of fibres per unit area along the surface. For example, regions that include a larger number of small diameter fibers are relatively more dense than regions in which fibers having a larger diameter are found. The presence of the smaller diameter fibers may render it possible to obtain a relatively soft application surface, whereas the larger-diameter fibres may render it possible to space the smaller diameter fibers apart, so as to create larger spaces between the fibers, which may render it possible to retain more product. Here again, an applicator may be obtained that has a relatively high take-up capacity while being relatively gentle during application.

Figure 3:
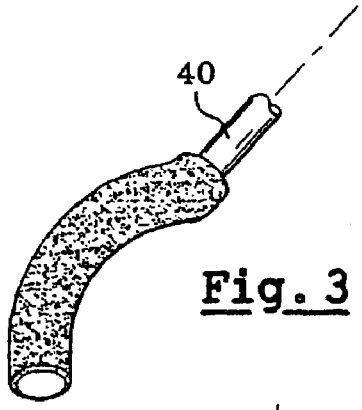
FIG. 3 partial schematic perspective view of a further embodiment of a device for applying a product.

FIG. 3 depicts another exemplary embodiment of an applicator 10. The application component differs from the one described with respect to FIG. 1 by virtue of the fact that the support 11 may be curved. The flocking layer depicted in more detail in FIG. 3A may include two types of fibers 13*e* and 13*f* having a circular cross-section, and substantially the same length of, for example, about 1 millimeter and substantially the same diameter of, for example, about 0.1 millimeter. The fibers 13*e* and 13*f* may have a different nature. For example, the fibers 13*e* may be formed of cotton and be curved, while the fibers 13*f* may be formed of polyester and be substantially straight. The mixture of fibers may include by weight, for example, about 25% curved fibers 13*e* and about 75% straight fibres 13*f*. The surface of the flocking layer hence includes relief irregularities resulting from the presence of spaces 14 formed between the straight fibers 13*f* and the curved fibers 13*e*. Such spaces may render it possible to retain a relatively large quantity of product.

Figure 4:
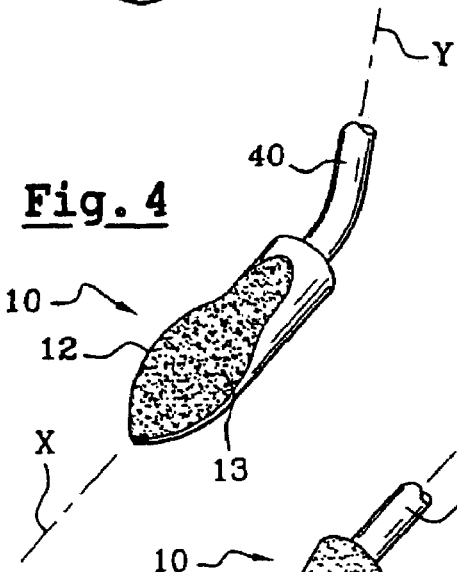
FIG. 4 is a partial schematic perspective view of another embodiment of a device for applying a product.

FIG. 4 depicts another exemplary embodiment of an applicator 10. In the embodiment shown in FIG. 4, the support 11 may be formed in the shape of a spatula having an axis X, which may be inclined with respect to an axis Y of the shaft 40. The support 11 may be formed of, for example, a polyamide. The flocking layer depicted in FIG. 4A may include two types of fibers 13*g* and 13*h* having both a different length and a different diameter. The fibers 13*g* may be, for example, rayon fibers and may have a length of about 1.2 millimeters and a diameter of about 0.1 millimeters. The fibers 13*h* may be, for example, polyester fibers and may have a length of about 0.5 millimeters and a diameter of about 0.2 millimeters. The mixture of fibers may include by weight, about 75% of longer fibers 13*g* and about 25% of shorter fibers 13*h*. The larger diameter fibers 13*h* may render it possible to separate and ventilate the smaller diameter fibers 13*g*. Spaces 14 may be obtained between the shorter fibers 13*h* and the longer fibers 13*g*, which may render it possible to obtain an applicator that has a relatively high take-up capacity. The presence of the longer fibers of smaller diameter 13*g* may render it possible to obtain an applicator which is relatively gentle during application. Such an applicator may, for example, be used for applying liquid lipstick.

Figure 5:
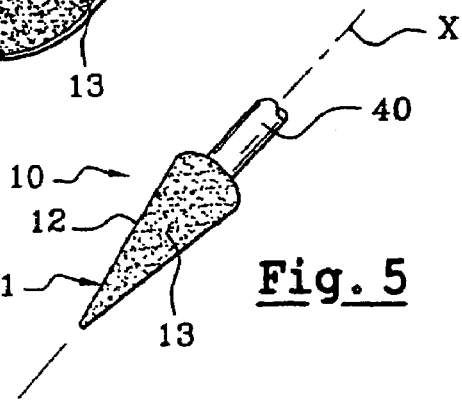
FIG. 5 is a partial schematic perspective view of a further embodiment of a device for applying a product.
Figure 5A:
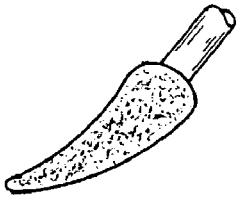
FIG. 5A is a partial schematic perspective view of another embodiment of a device for applying a product.
Figure 5B:
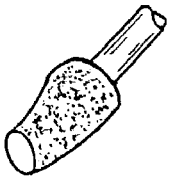
FIG. 5B is a partial schematic perspective view of a further embodiment of a device for applying a product.
Figure 5C:
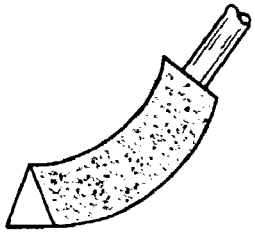
FIG. 5C is a partial schematic perspective view of another embodiment of a device for applying a product.
Figure 5D:
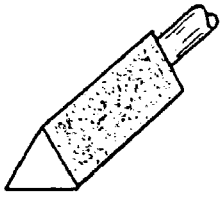
FIG. 5D is a partial schematic perspective view of a further embodiment of a device for applying a product.
Figure 5E:
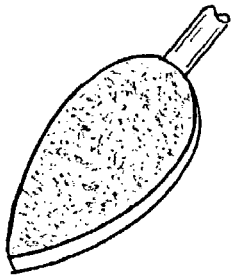
FIG. 5E is a partial schematic perspective view of another embodiment of a device for applying a product.
Figure 5F:
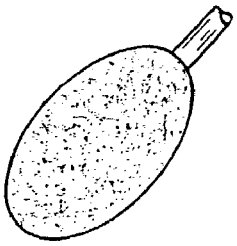
FIG. 5F is a partial schematic perspective view of a further embodiment of a device for applying a product.
Figure 5G:
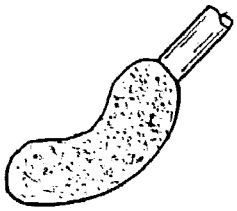
FIG. 5G is a partial schematic perspective view of another embodiment of a device for applying a product.

FIG. 5 depicts an exemplary embodiment of an applicator 10 that maybe used, for example, to apply mascara. The support 11 may be conical and have an axis X and may be fixed on the shaft 40 by, for example, adhesive bonding. The support 11 may be formed along the axis of the shaft 40. The support 11 may be formed of a porous material. The flocking layer may include two types of fibers 13 having a different nature but a substantially identical length, diameter, and cross-section. The flocking layer may include, for example, a mixture of relatively rigid fibers (e.g., polyester fibers) and relatively flexible fibers (e.g., viscose fibers). A difference in the relative hardness of the fibers may be perceptible to the touch because, when, for example, the surface of the flocking layer is pressed, the more rigid fibers remain virtually unflexed, whereas the more flexible fibers may flex more than the more rigid fibers when subjected to pressure. The fibers may have, for example, a circular cross-section, a length of about 2 millimeters, and a diameter of about 0.1 millimeter. The mixture of fibers may include about 20% by weight of relatively rigid fibers and about 80% by weight of relatively flexible fibers. The presence of the more rigid fibers may render it possible, for example, to comb the eyelashes, whereas the relatively less rigid fibers may provide relative softness during application.

FIGS. 5A through 5G depict other exemplary embodiments of applicators that may be used to apply product. For example, exemplary embodiments may include a support that has an elongate shape that defines one of a curved conical shape (see, e.g., FIG. 5A), a curved frustoconical shape (see, e.g., FIG. 5B), a curved prismatic shape (see, e.g., FIG. 5C), a straight prismatic shape (see, e.g., FIG. 5D), a feather-shape (see, e.g., FIG. 5E), a rugby ball-shape (see, e.g., FIG. 5F), and a bean-shape (see, e.g., FIG. 5G).

Figure 6:
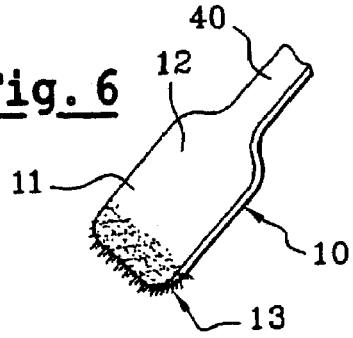
FIG. 6 is a partial schematic perspective view of another embodiment of a device for applying a product.
Figure 6A:
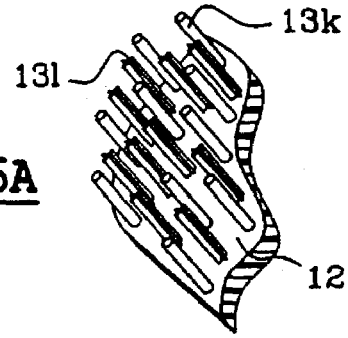
FIG. 6A is a schematic partial section view of the embodiment of FIG. 6.
Figure 7A:
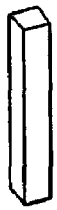
FIG. 7A is a schematic partial perspective view of an embodiment of a fiber.
Figure 7B:
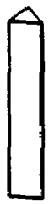
FIG. 7B is a schematic partial perspective view of another embodiment of a fiber.
Figure 7C:
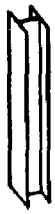
FIG. 7C is a schematic partial perspective view of a further embodiment of a fiber.
Figure 7D:
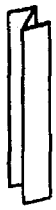
FIG. 7D is a schematic partial perspective view of another embodiment of a fiber.
Figure 7E:
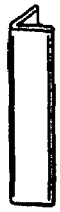
FIG. 7E is a schematic partial perspective view of a further embodiment of a fiber.
Figure 7F:
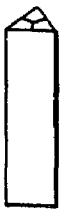
FIG. 7F is a schematic partial perspective view of another embodiment of a fiber.
Figure 7G:
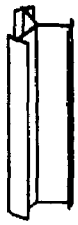
FIG. 7G is a schematic partial perspective view of a further embodiment of a fiber.
Figure 7H:
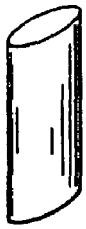
FIG. 7H is a schematic partial perspective view of another embodiment of a fiber.
Figure 7I:
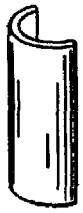
FIG. 7I is a schematic partial perspective view of a further embodiment of a fiber.
Figure 7J:
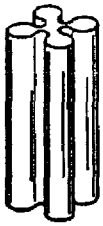
FIG. 7J is a schematic partial perspective view of another embodiment of a fiber.
Figure 7K:
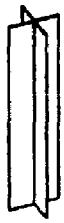
FIG. 7K is a schematic partial perspective view of a further embodiment of a fiber.
Figure 7L:
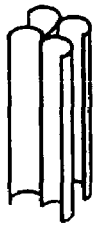
FIG. 7L is a schematic partial perspective view of another embodiment of a fiber.

FIG. 6 depicts an exemplary embodiment of an application component 10 that has a spatula-like shape, which may be obtained by molding in a single piece with the shaft 40 (e.g., a polyamide shaft). The application component 10 may have a rectangular shape and may be relatively thin, and its external surface 11 may be relatively smooth over substantially the entire length of the application component 10. Only a portion of the surface may be covered with a flocking layer, for example, at the opposite end from the shaft 40. The exemplary flocking layer depicted on an enlarged scale in FIG. 6A may include a mixture of two types of fibers 13*k* and 13*l* having substantially the same nature, substantially the same length, but a substantially different cross-section. The fibers 13*k* and 13*l* may be, for example, polyacrylic fibers having a length of about 1 millimeter. The fibers 13*k* may have, for example, a circular cross-section, whereas the fibers 13*l* may have a substantially cross-shaped cross-section, an example of which is depicted on an enlarged scale in FIG. 7K. The mixture of fibers may include, for example, about 50% by weight of fibers having a circular cross-section and about 50% by weight of fibers having a cross-shaped cross-section. By using fibers having different cross-sections, irregularities may be created which render it possible to increase the product retention capacity of the application component 10. For example, fibers having a different cross-section may not have the same capacity for product retention by capillary action since the external surface area of the fibers on which the product can be held may not be substantially the same. For example, when the fiber cross-section includes hollow portions (see, e.g., an exemplary hollow fiber as depicted in FIG. 7F), and/or a shape selected from H-shaped (see, e.g., FIG. 7C), Z-shaped (see, e.g., FIG. 7D), V-shaped (see, e.g., FIG. 7E), and/or cross-shaped (see e.g., FIGS. 7G and 7K), and/or a shape including concave portions (see, e.g., FIGS. 7I, 7J, and 7L), the product retention capacity of fibers having such cross-sections may have more product retention capacity than fibers having surfaces that have, for example, circularshaped, square-shaped (see FIG. 7A), triangular-shaped (see, e.g., FIG. 7B), or oval-shaped (see, e.g., FIG. 7H) cross-sections.

Figure 7M:
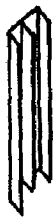
FIG. 7M is a schematic partial perspective view of a further embodiment of a fiber.
Figure 7N:
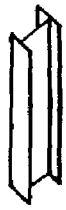
FIG. 7N is a schematic partial perspective view of another embodiment of a fiber.
Figure 7O:
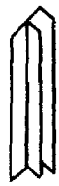
FIG. 7O is a schematic partial perspective view of a further embodiment of a fiber.
Figure 7P:
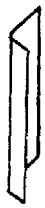
FIG. 7P is a schematic partial perspective view of another embodiment of a fiber.
Figure 7Q:
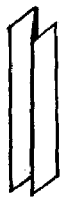
FIG. 7Q is a schematic partial perspective view of a further embodiment of a fiber.
Figure 7R:
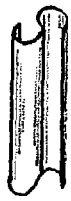
FIG. 7R is a schematic partial perspective view of another embodiment of a fiber.
Figure 7S:
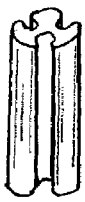
FIG. 7S is a schematic partial perspective view of a further embodiment of a fiber.
Figure 7T:
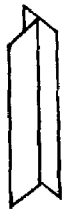
FIG. 7T is a schematic partial perspective view of another embodiment of a fiber.
Figure 7U:
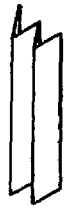
FIG. 7U is a schematic partial perspective view of a further embodiment of a fiber.
Figure 7V:
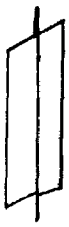
FIG. 7V is a schematic partial perspective view of another embodiment of a fiber.
Figure 7W:
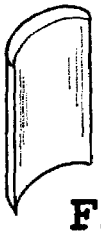
FIG. 7W is a schematic partial perspective view of a further embodiment of a fiber.
Figure 7X:
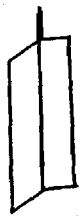
FIG. 7X is a schematic partial perspective view of another embodiment of a fiber.
Figure 7Y:
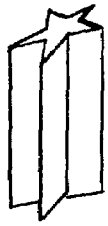
FIG. 7Y is a schematic partial perspective view of a further embodiment of a fiber.

FIGS. 7M through 7Y depict other exemplary embodiments of fiber cross-sections. For example, exemplary embodiments may include fibers having a cross-section selected from at least one of E-shaped (see, e.g., FIG. 7M), I-shaped (see, e.g., FIG. 7N), F-shaped (see, e.g., FIG. 7O), L-shaped (see, e.g., FIG. 7P), N-shaped (see, e.g., FIG. 7Q), S-shaped (see, e.g., FIG. 7R), trilobed (see, e.g., FIG. 7S), T-shaped (see, e.g., FIG. 7T), W-shaped (see, e.g., FIG. 7U), X-shaped (see, e.g., FIG. 7V), crescent-shaped (see, e.g., FIG. 7W), Y-shaped (see, e.g., FIG. 7X), and star-shaped (see, e.g., FIG. 7Y).

Figure 8:
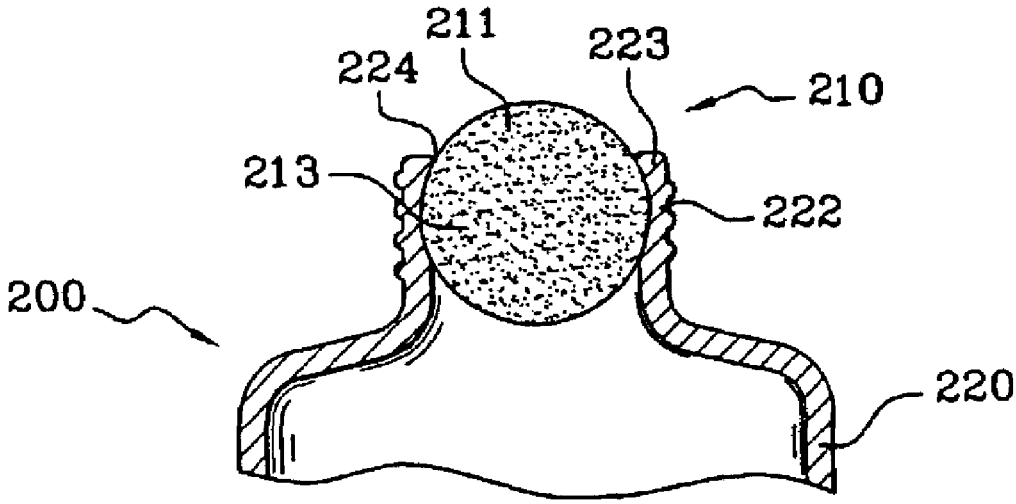
FIG. 8 is a schematic partial section view of another embodiment of a system for applying a product.

FIG. 8 depicts an exemplary embodiment of a packaging assembly 200 that may include an application device 210 including the support 211 that may have a substantially spherical shape. The support 211 may be fitted into the neck 222 of a container 220 and may protrude beyond the opening 224 delimited by a free edge 223 of the neck 22. The support 211 may turn like a "roll-on" type applicator in the neck 222, which may have a shape substantially matched to the support 211 (e.g., the support may be substantially spherical). The support 211, for example, may be substantially covered with a layer of flocking fibers 213 of different nature and substantially identical length, diameter, and cross-section. The flocking layer may include, for example, a mixture of relatively rigid fibers (e.g., polyester fibers) and relatively flexible fibers (e.g., viscose fibers), for example, at least somewhat like the exemplary embodiment depicted in FIG. 5.

Figure 3A:
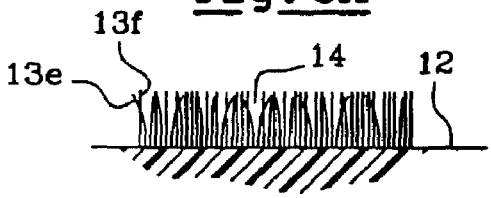
FIG. 3A is a schematic partial section view of the embodiment of FIG. 3.
Figure 4A:
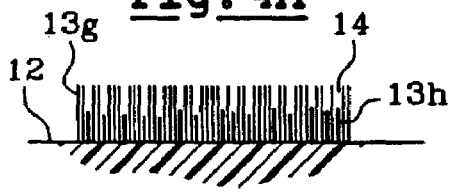
FIG. 4A is a schematic partial section view of the embodiment of FIG. 4.

The exemplary embodiments shown in, for example, FIGS. 2A, 3A, and 4A may include mixtures of at least two types of fibers. It is evident, however, that the flocking layer may include a mixture of more than two types of fibers, for example, that may be selected as a function of the make-up result that is intended to be obtained. Furthermore, the surface of an application component may be covered with a plurality of types of mixtures.

By altering, on the one hand, the nature, the shape, and/or the dimensions of the fibers and, on the other hand, the relative proportions of the various types of fibers included in the mixture, it may be possible to obtain application surfaces having a wide variety of characteristics. From the same support, an applicator that may be be used for different products and different types of make-up could be produced simply by changing the mixture of fibers included in the flocking layer.

The device according to some exemplary embodiments of the invention may be used to apply cosmetic products and/or care products, such as make-up products, dermatological substances, and/or pharmaceutical compositions used for treating and/or changing the appearance and/or scent of keratinous fibers. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A system for applying a product, the system comprising:

a device for applying a product, the device comprising:

a support defining at least one relief-free surface extending continuously over substantially the entire length of the support, the surface being at least partially covered with a flocking layer comprising fibers configured to allow the device to be loaded with the product, wherein the fibers comprise at least two fibers differing from one another, and wherein the at least two fibers are configured to define, at the surface of the flocking layer, irregularities which are at least one of visible to the naked eye and perceptible to the touch;

a reservoir; and the product to be applied by the device, the product being contained in the reservoir, wherein the reservoir comprises a free edge delimiting an opening, and wherein the device defines a substantially spherical shape and fits in the opening of the reservoir so as to be able to rotate at least partially in the reservoir.

2. A method of applying a product to a surface, the method comprising:

providing a system for applying a product, the system comprising:

a device for applying a product, the device comprising:

a support defining at least one relief-free surface extending continuously over substantially the entire length of the support, the surface being at least partially covered with a flocking layer comprising fibers configured to allow the device to be loaded with the product, wherein the fibers comprise at least two fibers differing from one another, and wherein the at least two fibers are configured to define, at the surface of the flocking layer, irregularities which are at least one of visible to the naked eye and perceptible to the touch;

a reservoir; and the product to be applied by the device, the product being contained in the reservoir; and placing the device in contact with the surface so as to apply the product to the surface, wherein the device is placed in contact with the surface without removing the device from the reservoir.

* * * * *